US010319300B2

(12) United States Patent
An et al.

(10) Patent No.: US 10,319,300 B2
(45) Date of Patent: Jun. 11, 2019

(54) DISPLAY DEVICE AND ELECTRONIC DEVICE HAVING THE SAME

(71) Applicant: Samsung Display Co., Ltd., Yongin-si, Gyeonggi-do (KR)

(72) Inventors: Jun-Yong An, Asan-si (KR); Ju-Hee Hyeon, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 88 days.

(21) Appl. No.: 15/068,263

(22) Filed: Mar. 11, 2016

(65) Prior Publication Data

US 2017/0061882 A1 Mar. 2, 2017

(30) Foreign Application Priority Data

Aug. 27, 2015 (KR) ..... 10-2015-0121248

(51) Int. Cl.

| | |
|---|---|
| ***G09G 3/30*** | (2006.01) |
| ***G09G 3/3241*** | (2016.01) |
| ***G09G 3/3266*** | (2016.01) |
| ***G09G 3/3291*** | (2016.01) |

(52) U.S. Cl.

CPC ..... *G09G 3/3241* (2013.01); *G09G 3/3266* (2013.01); *G09G 3/3291* (2013.01); *G09G 2300/02* (2013.01); *G09G 2320/0223* (2013.01)

(58) Field of Classification Search

CPC ..... G09G 2360/04; G09G 2300/026

USPC ..... 345/1.1, 76–82

See application file for complete search history.

(56) References Cited

U.S. PATENT DOCUMENTS

| | | | | |
|---|---|---|---|---|
| 2005/0264496 | A1* | 12/2005 | Shin | G09G 3/3233 345/76 |
| 2007/0001937 | A1* | 1/2007 | Park | G09G 3/3233 345/76 |
| 2012/0105496 | A1* | 5/2012 | Komiya | G09G 3/003 345/690 |
| 2015/0161928 | A1* | 6/2015 | Kim | G09G 3/20 345/1.3 |
| 2016/0171931 | A1* | 6/2016 | Liu | G09G 3/3208 345/694 |

FOREIGN PATENT DOCUMENTS

KR 10-2009-0036519 A 4/2009

* cited by examiner

*Primary Examiner* — Roy P Rabindranath

(74) *Attorney, Agent, or Firm* — Lewis Roca Rothgerber Christie LLP

(57) ABSTRACT

There is provided a display device including a display panel including a first display area and a second display area that include a plurality of pixels, a scan driver configured to provide a scan signal to the pixels, the scan driver being at least partially between the first display area and the second display area, a data driver configured to provide a data signal to the pixels, an emission controller configured to provide an emission control signal to the pixels, the emission controller being at a side of the first display area and at a side of the second display area, and a timing controller configured to generate a control signal that controls the scan driver, the data driver, and the emission controller.

13 Claims, 6 Drawing Sheets

DISPLAY DEVICE AND ELECTRONIC DEVICE HAVING THE SAME

CROSS-REFERENCE TO RELATED APPLICATION

This application claims priority to and the benefit of Korean Patent Application No. 10-2015-0121248, filed on Aug. 27, 2015 in the Korean Intellectual Property Office (KIPO), the content of which is incorporated herein in its entirety by reference.

BACKGROUND

1. Field

Aspects of the present invention relate to a display device and an electronic device including the same.

2. Description of the Related Art

Flat panel display (FPD) devices are widely used as display devices of electronic devices because FPD devices are relatively lightweight and thin compared to cathode-ray tube (CRT) display devices. Examples of FPD devices are liquid crystal display (LCD) devices, field emission display (FED) devices, plasma display panel (PDP) devices, and organic light emitting display (OLED) devices. The OLED devices have been spotlighted as next-generation display devices because the OLED devices have various advantages, such as a wide viewing angle, a rapid response speed, a thin thickness, low power consumption, etc.

A display panel includes a plurality of pixels. A plurality of signals may be provided to the pixels through lines formed in the display panel to drive the pixels. As the size and resolution of the display panel increases, the length of the lines formed in the display panel increases and a space between the lines decreases. Thus, the signals provided to pixels through the lines may be delayed due to a resistance of the lines and capacitances formed between the lines.

SUMMARY

Aspects of some embodiments of the present invention are directed to a display device capable of reducing delay of signals provided to pixels in a display panel through lines formed in the display panel.

Aspects of some embodiments of the present invention are directed to an electronic device capable of reducing delay of signals provided to pixels in a display panel through lines formed in the display panel.

According to some example embodiments of the present invention, there is provided a display device including: a display panel including a first display area and a second display area that include a plurality of pixels; a scan driver configured to provide a scan signal to the pixels, the scan driver being at least partially between the first display area and the second display area; a data driver configured to provide a data signal to the pixels; an emission controller configured to provide an emission control signal to the pixels, the emission controller being at a side of the first display area and at a side of the second display area; and a timing controller configured to generate a control signal that controls the scan driver, the data driver, and the emission controller.

In an embodiment, the scan driver includes: a first scan driver at both sides of the first display area; and a second scan driver at the both sides of the second display area.

In an embodiment, the first scan driver and the second scan driver are in a non-display area between the first display area and the second display area.

In an embodiment, the scan driver includes: a first scan driver at one side of the first display area; and a second scan driver at one side of the second display area.

In an embodiment, the first scan driver and the second scan driver are in a non-display area between the first display area and the second display area.

In an embodiment, the emission controller includes: a first emission controller at both sides of the first display area; and a second emission controller at the both sides of the second display area.

In an embodiment, the first emission controller and the second emission controller are in a non-display area between the first display area and the second display area.

In an embodiment, the emission controller includes: a first emission controller at one side of the first display area; and a second emission controller at one side of the second display area.

In an embodiment, the first emission controller and the second emission controller are in a non-display area between the first display area and the second display area.

In an embodiment, the scan driver includes a plurality of scan driving circuits configured to generate the scan signal provided to the pixels, and the emission controller includes a plurality of emission controlling circuits configured to generate the emission control signal provided to the pixels.

According to some example embodiments of the present invention, there is provided an electronic device including a display device and a processor that controls the display device, wherein the display device includes: a display panel including a first display area and a second display area, the first and second display areas including a plurality of pixels; a scan driver configured to provide a scan signal to the pixels, the scan driver being at least partially between the first display area and the second display area; a data driver configured to provide a data signal to the pixels; an emission controller configured to provide an emission control signal to the pixels, the emission controller being at a side of the first display area and at a side of the second display area; and a timing controller configured to generate a control signal that controls the scan driver, the data driver, and the emission controller.

In an embodiment, the scan driver includes: a first scan driver at both sides of the first display area; and a second scan driver at the both sides of the second display area.

In an embodiment, the first scan driver and the second scan driver are in a non-display area between the first display area and the second display area.

In an embodiment, the scan driver includes: a first scan driver at one side of the first display area; and a second scan driver at one side of the second display area.

In an embodiment, the first scan driver and the second scan driver are in a non-display area between the first display area and the second display area.

In an embodiment, the emission controller includes: a first emission controller at both sides of the first display area; and a second emission controller at the both sides of the second display area.

In an embodiment, the first emission controller and the second emission controller are in a non-display area between the first display area and the second display area.

In an embodiment, the emission controller includes: a first emission controller at one side of the first display area; and a second emission controller at one side of the second display area.

In an embodiment, the first emission controller and the second emission controller are in a non-display area between the first display area and the second display area.

In an embodiment, the scan driver includes a plurality of scan driving circuits configured to generate the scan signal provided to the pixels, and the emission controller includes a plurality of emission controlling circuits configured to generate the emission control signal provided to the pixels.

Therefore, a display device and an electronic device having the same according to example embodiments of the present invention may reduce a delay of a scan signal and an emission control signal provided to a pixel by dividing a display area into a first display area and a second display area, and providing each of the scan signal and the emission control signal to both sides of the first display area and both sides of the second display area.

BRIEF DESCRIPTION OF THE DRAWINGS

Illustrative, non-limiting example embodiments will be more clearly understood from the following detailed description taken in conjunction with the accompanying drawings.

DETAILED DESCRIPTION

Hereinafter, the present inventive concept will be explained in detail with reference to the accompanying drawings.

Figure 1:
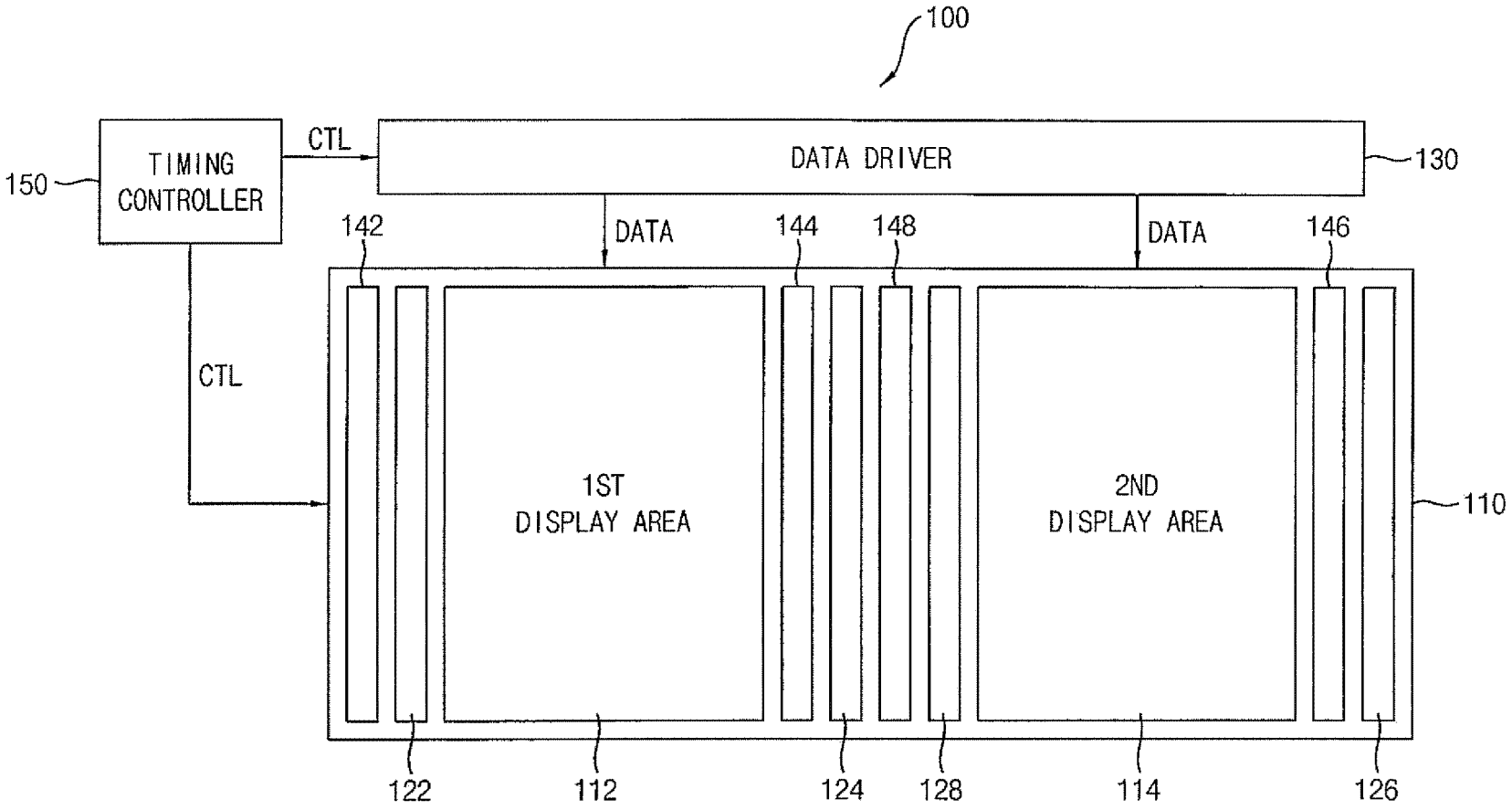
FIG. 1 is a block diagram illustrating a display device according to some example embodiments of the present invention.
Figure 2:
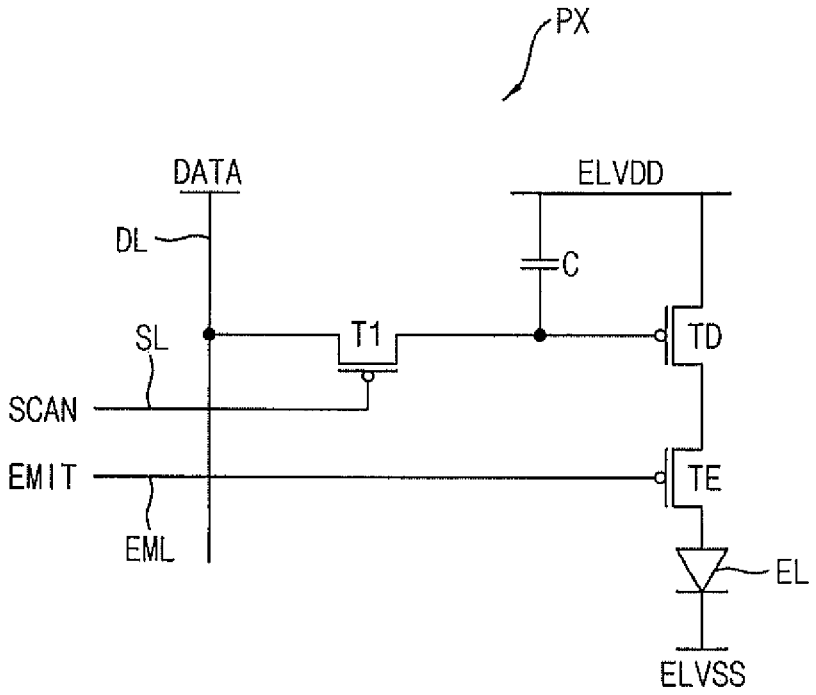
FIG. 2 is a circuit diagram illustrating an example of a pixel included in the display device of FIG. 1.

FIG. 1 is a block diagram illustrating a display device according to some example embodiments of the present invention, and FIG. 2 is a circuit diagram illustrating an example of a pixel included in the display device of FIG. 1.

Referring to FIGS. 1 and 2, a display device 100 may include a display panel 110, a scan driver 122, 124, 126, and 128, a data driver 130, an emission controller 142, 144, 146, and 148, and a timing controller 150.

The display panel 110 may include a first display area 112 and a second display area 114 that include a plurality of pixels Px. A plurality of data lines DL, a plurality of scan lines SL, and a plurality of emission control lines EML may be formed in each of the first display area 112 and the second display area 114. The pixels Px may be formed at crossing regions of the data lines DL and the scan lines SL in the first display area 112 and the second display area 114. Referring to FIG. 2, each of the pixels Px may include an organic light emitting diode EL, a switching transistor T1, a storage capacitor C, a driving transistor TD and an emission transistor TE. In this example, the driving transistor TD may control a driving current flowing through the organic light emitting diode EL based on the data signal DATA. The data signal DATA is provided to the driving transistor TD via the data line DL in response to the scan signal SCAN, where the scan signal SCAN is provided via the scan line SL. The emission transistor TE may be disposed between the organic light emitting diode EL and the driving transistor TD. The emission transistor TE may provide the driving current to the organic light emitting diode EL in response to an emission control signal EMIT provided through the emission control line EML. Thus, the organic light emitting diode EL may emit light.

The scan driver 122, 124, 126, and 128 may provide the scan signals SCAN to the pixels Px. The scan driver 122, 124, 126, and 128 may be formed at sides of the first display area 112 and at sides of the second display area 114. The scan driver 122, 124, 126, and 128 may include first scan drivers 122 and 124, and second scan drivers 126 and 128.

In some example embodiments, the first scan drivers 122 and 124 may be formed at both sides of the first display area 112, and the second scan drivers 126 and 128 may be formed at both sides of the second display area 114. The first scan drivers 122 and 124 may be coupled to the scan lines SL in the first display area 112. The first scan drivers 122 and 124 may provide the scan signals SCAN to the switching transistor T1 of the pixels Px formed in the first display area 112 through the scan lines SL in the first display area 112. Here, the first scan driver 124 of the first scan drivers 122 and 124 may be formed in a non-display area disposed between the first display area 112 and the second display area 114. The second scan drivers 126 and 128 may be coupled to the scan lines SL in the second display area 114. The second scan drivers 126 and 128 may provide the scan signals SCAN to the switching transistor T1 of the pixels Px formed in the second display area 114 through the scan lines SL in the second display area 114. Here, the second scan driver 128 of the second scan drivers 126 and 128 may be formed in the non-display area disposed between the first display area 112 and the second display area 114.

As described above, the scan signals SCAN may be provided to both sides of the scan lines SL by forming the first scan drivers 122 and 124 at both sides of the first display area 112 and forming the second scan drivers 126 and 128 at both sides of the second display area 114. Thus, a delay of the scan signals SCAN resulting from resistance of the scan lines SL and capacitance between the scan lines SL may be reduced.

In some example embodiments, the first scan driver 122 and 124 may be formed at one side of the first display area 112 and the second scan driver 126 and 128 may be formed at one side of the second display area 114. Although the scan driver that includes two first scan drivers 122 and 124 is described in FIG. 1, the scan driver may include one first scan driver. For example, the scan driver may include one first scan driver 122 disposed at a left side of the first display area 112 or one first scan driver 124 disposed at a right side of the first display area 112 (i.e., the non-display area formed between the first display area 112 and the second display area 114). Further, although the scan driver that includes two second scan drivers 126 and 128 is described in FIG. 1, the scan driver may include one second scan driver. For example, the scan driver may include one second scan driver 126 disposed at a right side of the second display area 114 or one second scan driver 128 disposed at a left side of the second display area 114 (i.e., the non-display area formed between the first display area 112 and the second display area 114).

The data driver 130 may provide the data signal DATA to the pixels Px. The data driver may convert an image signal provided from an external device into the data signal DATA. Specifically, the data driver 130 may convert the image signal to an analog voltage corresponding to a grayscale value. The data driver 130 may provide the analog voltage to the pixels in the first display area 112 and the second display area 114 as the data signal DATA. The timing controller 150 may generate a control signal CTL that controls the scan driver 122, 124, 126, and 129, the data driver 130, and the emission controller 142, 144, 146, and 148.

The emission controller 142, 144, 146, and 148 may provide the emission control signals EMIT to the pixels Px. The emission controller 142, 144, 146, and 148 may formed at a side of the first display area 112 and at a side of the second display area 114. The emission controller 142, 144, 146, and 148 may include a first emission controller 142 and 144, and a second emission controller 146 and 148.

In some example embodiments, the first emission controllers 142 and 144 may be formed at both sides of the first display area 112 and the second emission controllers 146 and 148 may be formed at both sides of the second display area 114. The first emission controllers 142 and 144 may be coupled to the emission control lines EML in the first display area 112. The first emission controllers 142 and 144 may provide the emission control signals EMIT to the emission transistor TE of the pixels Px formed in the first display area 112 through the emission control lines EML in the first display area 112. Here, the first emission controller 144 of the first emission controllers 142 and 144 may be formed in the non-display area disposed between the first display area 112 and the second display area 114. The second emission controllers 146 and 148 may be coupled to the emission control lines EML in the second display area 114. The second emission controllers 146 and 148 may provide the emission control signals EMIT to the emission transistor TE of the pixels Px formed in the second display area 114 through the emission control lines EML in the second display area 114. Here, the second emission controller 148 of the second emission controllers 146 and 148 may be formed in the non-display area disposed between the first display area 112 and the second display area 114. As described above, the emission control signals EMIT may be provided to both sides of the emission control lines EML by forming the first emission controllers 142 and 144 at both sides of the first display area 112 and forming the second emission controllers 146 and 148 at both sides of the second display area 114. Thus, a delay of the emission control signals EMIT resulting from resistance of the emission control lines EML and capacitance between the emission control lines EML may be reduced.

In other example embodiments, the first emission controller 142 and 144 may be formed at one side the first display area 112 and the second emission controller 146 and 148 may be formed at one side of the second display area 114. Although the emission controller that includes two first emission controllers 142 and 144 is described in FIG. 1, the emission controller may include only one first emission controller. For example, the emission controller may include one first emission controller 142 disposed at a left side of the first display area 112 or one first emission controller 144 disposed at a right side of the first display area 112 (i.e., in the non-display area formed between the first display area 112 and the second display area 114). Further, although the emission controller that includes two second emission controllers 146 and 148 is described in FIG. 1, the emission controller may include only one second emission controller. For example, the emission controller may include one second emission controller 146 disposed at a right side of the second display area 114 or one second emission controller 148 disposed at a left side of the second display area 114 (i.e., in the non-display area formed between the first display area 112 and the second display area 114).

Generally, the scan driver 122, 124, 126, and 128 and the emission controller 142, 144, 146, and 148 may be formed at both sides of the display panel 110. As the size and resolution of the display panel 110 increases, the length of lines (e.g., scan lines, emission lines, data lines, . . . ) increases and the spacing between the lines decreases. Here, signals (e.g., scan signals, emission control signals, data signals . . . ) provided to the pixels Px through the lines may be delayed as a result of line resistance and capacitances formed between the lines. The display device 100 according to example embodiments may divide the display area of the display panel 110 into the first display area 112 and the second display area 114, and may additionally form the scan driver 122, 124, 126 and 128 and the emission controller 142, 144, 146, and 148 in the non-display area that is formed between the first display area 112 and the second display area 114. Thus, the scan signals SCAN and the emission control signals EMIT may be stably provided to the pixels Px without delay or with reduced (e.g., minimal) delay.

Figure 3:
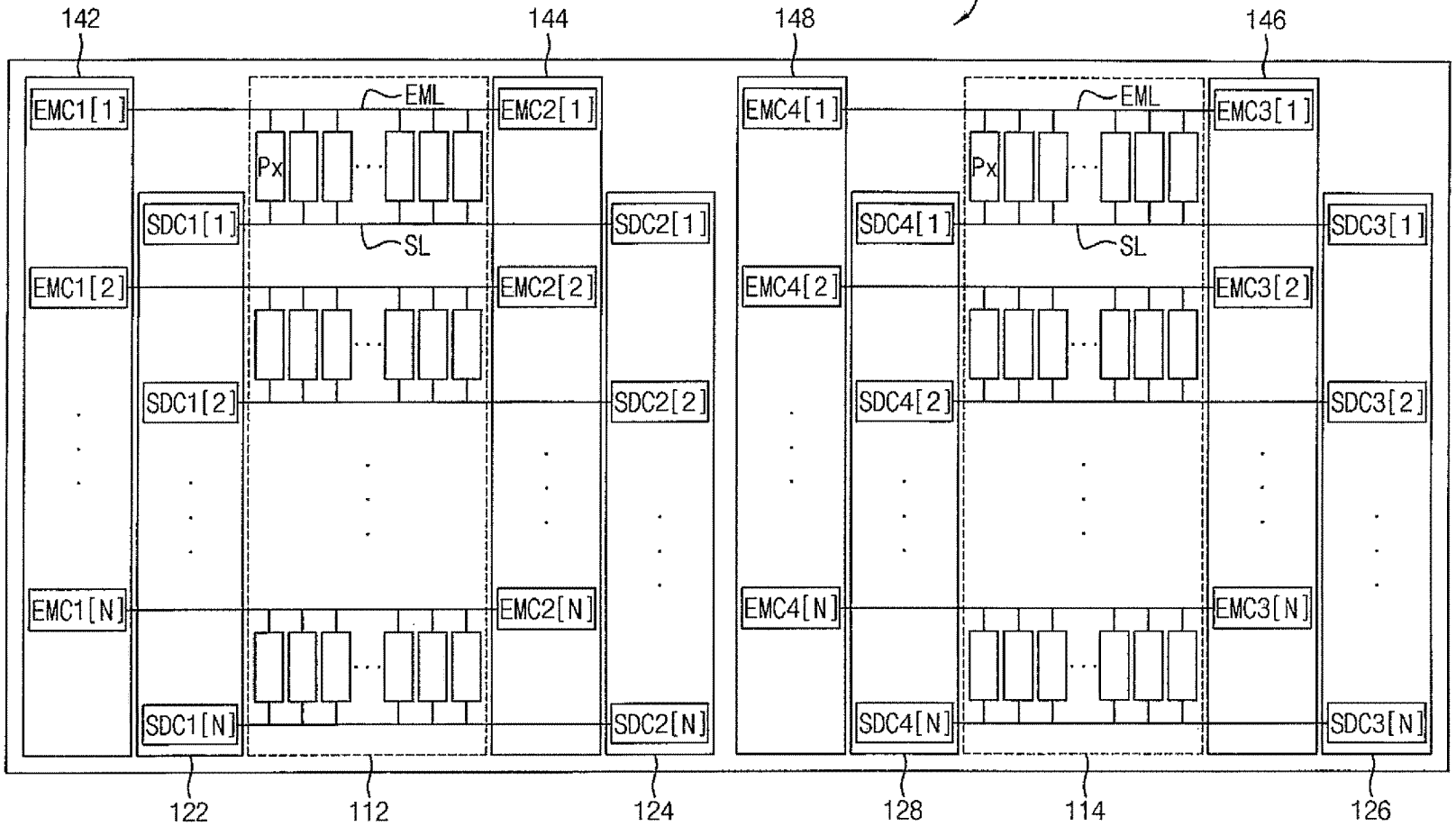
FIG. 3 is a block diagram illustrating a display panel, a scan driver, and an emission controller included in the display device of FIG. 1.
Figure 4:
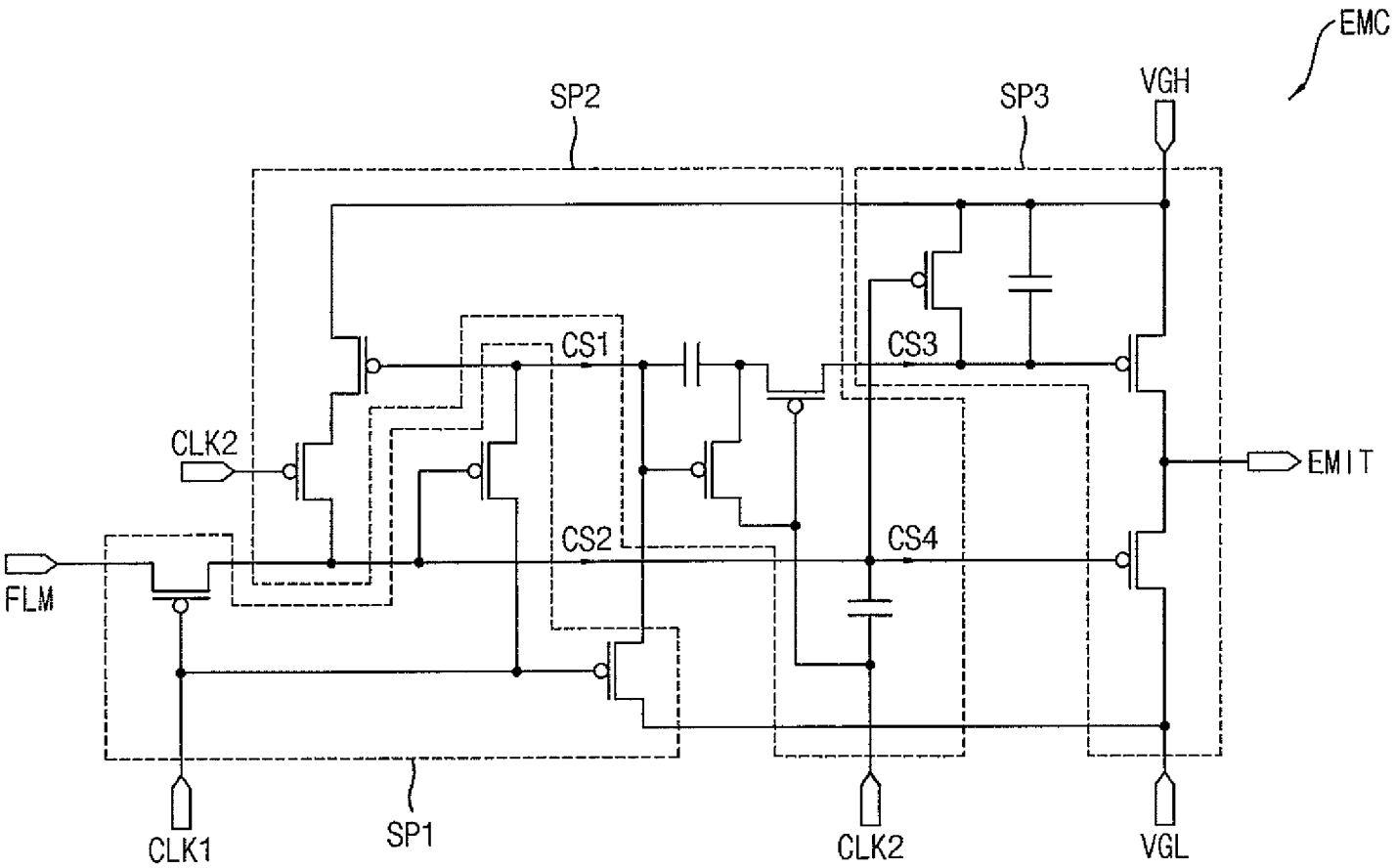
FIG. 4 is a circuit diagram illustrating an example of an emission controlling circuit included in the emission controller of FIG. 3.

FIG. 3 is a circuit diagram illustrating a display panel, a scan driver and an emission controller included in the display device of FIG. 1, and FIG. 4 is a circuit diagram illustrating an example of an emission controlling circuit included in the emission controller of FIG. 3.

The display panel 110 may include the first display area 112 and the second display area 114. The first scan drivers 122 and 124 may be formed at both sides of the first display area 112, and the second scan drivers 126 and 128 may be formed at both sides of the second display area 114. The first scan driver 124 of the first scan drivers 122 and 124 and the second scan driver 128 of the second scan drivers 126 and 128 may be formed in the non-display area disposed between the first display area 112 and the second display area 114. The first scan drivers 122 and 124 may provide the scan signals to the pixels Px in the first display area 112 through the scan lines SL formed in the first display area 112. Each of the first scan drivers 122 and 124 may include a plurality of scan driving circuits SDC. The scan driving circuits SDC1 and SDC2 of the first scan drivers 122 and 124 may provide the scan signals to both sides of the scan line SL coupled to the pixels Px in the first display area 112. The second scan drivers 126 and 128 may provide the scan signals to the pixels Px in the second display area 114 through the scan lines SL formed in the second display area 114. Each of the second scan drivers 126 and 128 may include the plurality of scan driving circuits SDC. The scan driving circuits SDC3 and SDC4 of the second scan drivers 126 and 128 may provide the scan signals to both sides of the scan line SL coupled to the pixels Px in the second display area 114.

The first emission controllers 142 and 144 may be formed at both sides of the first display area 112 and the second emission controllers 146 and 148 may be formed at both sides of the second display area 114. The first emission controller 144 of the first emission controllers 142 and 144 and the second emission controller 148 of the second emission controllers 146 and 148 may be formed in the non-display area disposed between the first display area 112 and the second display area 114. The first emission controllers 142 and 144 may provide the emission control signals EMIT to the pixels Px in the first display area 112 though the emission control line EML formed in the first display area 112. Each of the first emission controllers 142 and 144 may include a plurality of emission controlling circuits EMC.

Referring to FIG. 4, each of the emission controllers 142, 144, 146 and 148 may include the emission controlling circuit EMC that generates the emission control signals EMIT provided to the emission transistor of the pixels Px through the emission control line EML. The emission controlling circuit EMC may be operated in response to a start signal FLM, a first clock signal CLK1, and a second clock signal CLK2. A first signal processing block SP1 may receive the start signal FLM and the first clock signal CLK1. The first signal processing block SP1 may receive a first voltage VGL and a second voltage VGH and generate a first signal CS1 and a second signal CS2 in response to the start signal FLM and the first clock signal CLK1. The first signal CS1 and the second signal CS2 may be provided to a second signal processing block SP2. The second signal processing block SP2 may generate a third signal CS3 and a fourth signal CS4 in response to the second clock signal CLK2, the first signal CS1, and the second signal CS2. The third signal CS3 and the fourth signal CS4 may be provided to a third signal processing block SP3. The third signal processing block SP3 may receive the first voltage VGL and the second voltage VGH and may generate the emission control signal EMIT in response to the third signal CS3 and the fourth signal CS4. The emission controlling circuits EMC1 and EMC2 of the first emission controllers 142 and 144 may provide the emission control signals EMIT to both sides of the emission control line EML coupled to the pixels Px in the first display area 112. The second emission controllers 146 and 148 may provide the emission control signals EMIT to the pixels in the second display area 114 through the emission control lines EML formed in the second display area 114. Each of the second emission controllers 146 and 148 may include the plurality of emission controlling circuits EMC. The emission controlling circuits EMC3 and EMC4 of the second emission controllers 146 and 148 may provide the emission control signals EMIT to both sides of the emission control lines EML coupled to the pixels Px in the second display area 114.

Figure 5:
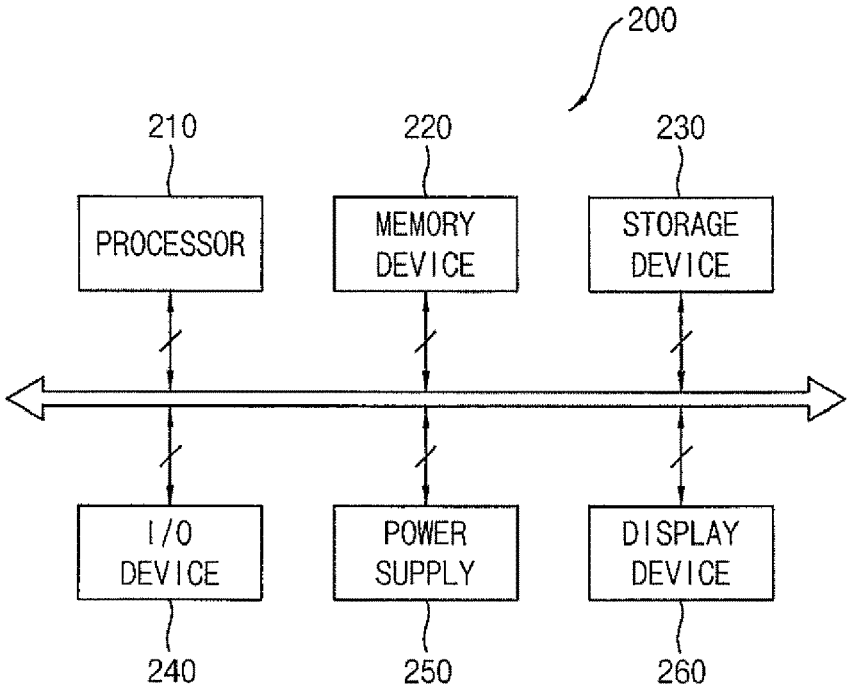
FIG. 5 is a block diagram illustrating an electronic device according to some example embodiments of the present invention.
Figure 6:
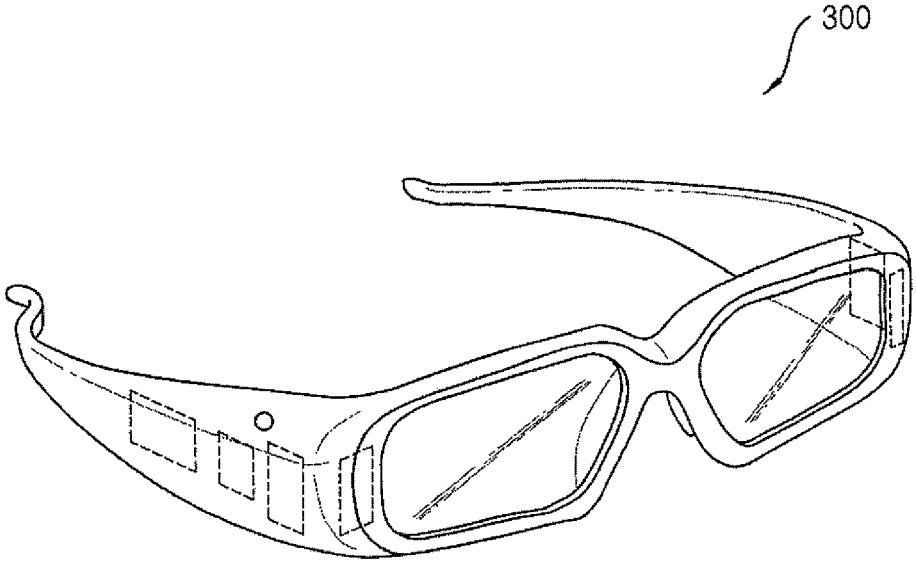
FIG. 6 is a diagram illustrating an example embodiment in which the electronic device of FIG. 5 is implemented as a head mount display device.
Figure 7:
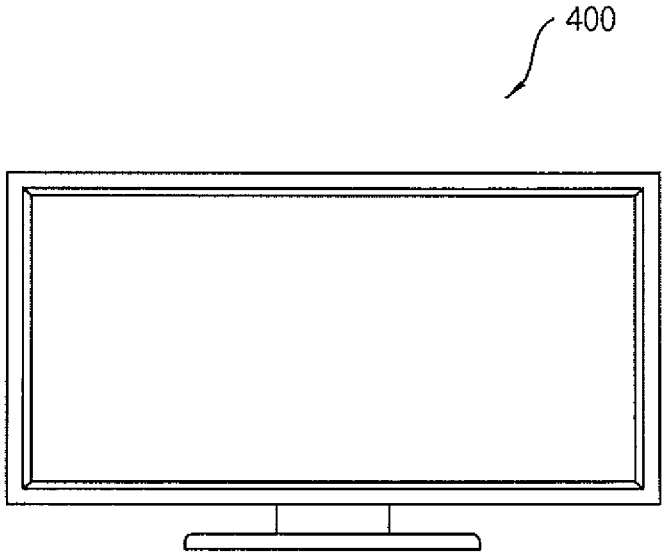
FIG. 7 is a diagram illustrating an example embodiment in which the electronic device of FIG. 5 is implemented as a television device.

FIG. 5 is a block diagram illustrating an electronic device according to some example embodiments of the present invention. FIG. 6 is a diagram illustrating an example embodiment in which the electronic device of FIG. 5 is implemented as a head mount display device. FIG. 7 is a diagram illustrating an example embodiment in which the electronic device of FIG. 5 is implemented as a television device.

Referring to FIGS. 5 through 7, an electronic device 200 may include a processor 210, a memory device 220, a storage device 230, an input/output (I/O) device 240, a power device 250, and a display device 260. Here, the display device 260 may correspond to the display device 100 of FIG. 1. In addition, the electronic device 200 may further include a plurality of ports for communicating to a video card, a sound card, a memory card, a universal serial bus (USB) device, and other electronic device. Although it is illustrated in FIGS. 6 and 7 that the electronic device 200 is implemented as a head mount display (HMD) 300 or a television device 400, a kind of the electronic device 200 is not limited thereto.

The processor 210 may perform various computing functions. The processor 210 may be a microprocessor, a central processing unit (CPU), and/or the like. The processor 210 may be coupled to other components via an address bus, a control bus, a data bus, and/or the like. Further, the processor 210 may be coupled to an extended bus, such as peripheral component interconnect (PCI) bus. The memory device 220 may store data for operations of the electronic device 200. For example, the memory device 220 may include at least one non-volatile memory device, such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, and the like, and/or at least one volatile memory device, such as a dynamic random access memory (DRAM) device, a static random access memory (SRAM) device, a mobile DRAM device, and the like. The storage device 230 may be a solid stage drive (SSD) device, a hard disk drive (HDD) device, a CD-ROM device, and/or the like.

The I/O device 240 may be an input device, such as a keyboard, a keypad, a touchpad, a touch-screen, a mouse, or the like, and an output device, such as a printer, a speaker, and/or the like. In some example embodiments, the display device 260 may be included in the I/O device 240. The power device 250 may provide a power for operations of the electronic device 200. The display device 260 may communicate with other components via the buses or other communication links. As described above, the display device 260 may include a scan driver, a data driver, an emission controller, and a timing controller. The display panel may include a first display area and a second display area that include a plurality of pixels. A plurality of data lines, a plurality of scan lines, and a plurality of emission control lines may be formed in each of the first display area and the second display area. The pixels may be formed at crossing regions of the scan lines and the data lines.

The scan driver may provide a scan signals to the pixels. The scan driver may be formed at a side of the first display area and at a side of the second display area. The scan driver may include a first scan driver and a second scan driver. In some example embodiments, the first scan drivers may be formed at both sides of the first display area and the second scan drivers may be formed at both sides of the second display area. The first scan drivers may be coupled to the scan lines in the first display area. The first scan drivers may include a plurality of scan driving circuits. The scan driving circuit of the first scan driver may be coupled to the scan lines in the first display area. The scan driving circuit of the first scan driver may provide the scan signal to both sides of the scan line coupled to the pixels in the first display area. The second scan driver may be coupled to the scan lines in the second display area. The second scan driver may include the plurality of scan driving circuits. The scan driving circuit of the second scan driver may be coupled to the scan lines in the second display area. The scan driving circuit of the second scan driver may provide the scan signal to both sides of the scan line coupled to the pixels in the second display area. In other example embodiments, the first scan driver may be formed at one side of the first display area and the second scan driver may be formed at one side of the second display area. The first scan driver may be formed at a left side or at a right side of the first display area. Here, the left side or the right side of the first display area may be a non-display area formed between the first display area and the second display area. The second scan driver may be formed at a left side or at a right side of the second display area. Here, the left side or the right side of the second display area may be the non-display area formed between the first display area and the second display area.

The emission controller may provide an emission control signal to the pixels. The emission controller may be formed at a side of the first display area and at a side of the second display area. The emission controller may include a first emission controller and a second emission controller. In some example embodiments, the first emission controllers may be formed at both sides of the first display area and the second emission controllers may be formed at both sides of the second display area. The first emission controllers may be coupled to the emission control lines in the first display area. The first emission controller may include a plurality of emission controlling circuits. The emission controlling circuit of the first emission controller may be coupled to the emission control lines in the first display area. The emission controlling circuit of the first emission controller may provide the emission control signal to both sides of the emission control line coupled to the pixels in the first display area. The second emission controllers may be coupled to the emission control lines in the second display area. The second emission controller may include the plurality of emission controlling circuits. The emission controlling circuit of the second emission controller may be coupled to the emission control lines in the second display area. The emission controlling circuit of the second emission controller may provide the emission control signal to both sides of the emission control line coupled to the pixels in the second display area. In other example embodiments, the first emission controller may be formed at one side of the first display area and the second emission controller may be formed at one side of the second display area. The first emission controller may be formed at the left side or right side of the first display area. Here, the left side or the right side of the first display area may be the non-display area formed between the first display area and the second display area. The second emission controller may be formed at the left side or right side of the second display area. Here, the left side or the right side of the second display area may be the non-display area formed between the first display area and the second display area.

The data driver may provide a data signal to the pixels in the first display area and the second display area. The timing controller may generate a control signal that controls the scan driver, the data driver, and the emission controller.

As described above, the electronic device 200 of FIG. 5 may divide the display area into the first display area and the second display area and may additionally form the scan driver and the emission controller in the non-display area formed between the first display area and the second display area. Thus, the scan signals and the emission control signals may be stably provided to the pixels without delay or with reduced (e.g., minimal) delay.

The present inventive concept may be applied to a display device and an electronic device having the display device. For example, the present inventive concept may be applied to a computer monitor, a laptop, a digital camera, a cellular phone, a smart phone, a smart pad, a television, a personal digital assistant (PDA), a portable multimedia player (PMP), a MP3 player, a navigation system, a game console, a video phone, and/or the like.

It will be understood that, although the terms "first", "second", "third", etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section discussed below could be termed a second element, component, region, layer or section, without departing from the spirit and scope of the inventive concept.

The terminology used herein is for the purpose of describing particular embodiments and is not intended to be limiting of the inventive concept. As used herein, the singular forms "a" and "an" are intended to include the plural forms as well, unless the context clearly indicates otherwise. It will be further understood that the terms "include," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the inventive concept refers to "one or more embodiments of the inventive concept."

It will be understood that when an element or layer is referred to as being "connected to" or "coupled to" another element, it can be directly connected to or coupled to the other element, or one or more intervening elements may be present. When an element is referred to as being "directly connected to" or "directly coupled to" another element, there are no intervening elements present.

As used herein, the terms "use," "using," and "used" may be considered synonymous with the terms "utilize," "utilizing," and "utilized," respectively.

The display device and/or any other relevant devices or components, such as the scan and emission controllers and processor, according to embodiments of the present invention described herein may be implemented utilizing any suitable hardware, firmware (e.g. an application-specific integrated circuit), software, or a suitable combination of software, firmware, and hardware. For example, the various components of the display device may be formed on one integrated circuit (IC) chip or on separate IC chips. Further, the various components of the display device may be implemented on a flexible printed circuit film, a tape carrier package (TCP), a printed circuit board (PCB), or formed on a same substrate. Further, the various components of the display device may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the scope of the embodiments of the present invention.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the present inventive concept. Accordingly, all such modifications are intended to be included within the spirit and scope of the present inventive concept as defined by the claims and equivalents thereof. Therefore, it is to be understood that the foregoing is illustrative of various example embodiments and is not to be construed as limited to the specific example embodiments disclosed, and that suitable modifications to the disclosed example embodiments, as well as other example embodiments, are intended to be included within the scope of the appended claims.

What is claimed is:

1. A display device comprising:

a display panel comprising a first display area and a second display area that comprise a plurality of pixels, the first display area being connected to a first emission controller, a plurality of first scan drivers, and a data driver, and the second display area being connected to a second emission controller, a plurality of second scan drivers, and the data driver, the first display area comprising a first emission control line having a first end and a second end;

the plurality of first and second scan drivers, the plurality of first and second scan drivers being configured to provide a scan signal to the pixels, at least one first scan driver among the plurality of first scan drivers and at least one second scan driver among the plurality of second scan drivers being between the first display area and the second display area;

the data driver, the data driver being configured to provide a data signal to the pixels;

the first and second emission controllers, the first and second emission controllers being configured to provide an emission control signal to the pixels, the second emission controller being located between the first display area and the second display area, the first emission controller comprising a first portion and a second portion, the first end of the first emission control line being directly coupled to the first portion of the first emission controller, the second end of the first emission control line being directly coupled to the second portion of the first emission controller, the first emission controller being configured to apply the emission control signal to the first emission control line by applying the emission control signal to the first end utilizing the first portion of the first emission controller and to the second end utilizing the second portion of the first emission controller; and a timing controller configured to generate a control signal that controls the plurality of first and second scan drivers, the data driver, and the first and second emission controllers.

2. The display device of claim 1, wherein:

the plurality of first scan drivers are located at both sides of the first display area; and the plurality of second scan drivers are located at the both sides of the second display area.

3. The display device of claim 1, wherein:

the first emission controller is located at one side of the first display area; and the second emission controller is located at one side of the second display area.

4. The display device of claim 1, wherein the plurality of first and second scan drivers comprise a plurality of scan driving circuits configured to generate the scan signal provided to the pixels, and wherein the first and second emission controllers comprise a plurality of emission controlling circuits configured to generate the emission control signal provided to the pixels.

5. The display device of claim 1, wherein the first emission controller provides an emission control signal to the pixels in the first display area and the second emission controller provides an emission control signal to the pixels in the second display area.

6. The display device of claim 1, wherein the second emission controller comprises a first portion and a second portion, and the second display area comprises a second emission control line having a first end and a second end, the first end of the second emission control line being directly coupled to the first portion of the second emission controller, the second end of the second emission control line being directly coupled to the second portion of the second emission controller, the second emission controller being configured to apply the emission control signal to the second emission control line by applying the emission control signal to the first end of the second emission control line utilizing the first portion of the second emission controller and to the second end of the second emission control line utilizing the second portion of the second emission controller.

7. An electronic device comprising a display device and a processor that controls the display device, wherein the display device comprises:

a display panel comprising a first display area and a second display area, the first and second display areas comprising a plurality of pixels, the first display area being connected to a first emission controller, a plurality of first scan drivers, and a data driver, and the second display area being connected to a second emission controller, a plurality of second scan drivers, and the data driver, the first display area comprising a first emission control line having a first end and a second end;

the plurality of first and second scan drivers, the plurality of first and second scan drivers being configured to provide a scan signal to the pixels, at least one first scan driver among the plurality of first scan drivers and at least one second scan driver among the plurality of second scan drivers being between the first display area and the second display area;

the data driver, the data driver being configured to provide a data signal to the pixels;

the first and second emission controllers, the first and second emission controllers being configured to provide an emission control signal to the pixels, the second emission controller being located between the first display area and the second display area, the first emission controller comprising a first portion and a second portion, the first end of the first emission control line being directly coupled to the first portion of the first emission controller, the second end of the first emission control line being directly coupled to the second portion of the first emission controller, the first emission controller being configured to apply the emission control signal to the first emission control line by applying the emission control signal to the first end utilizing the first portion of the first emission controller and to the second end utilizing the second portion of the first emission controller; and a timing controller configured to generate a control signal that controls the plurality of first and second scan drivers, the data driver, and the first and second emission controllers.

8. The electronic device of claim 7, wherein:

the plurality of first scan drivers are located at both sides of the first display area; and the plurality of second scan drivers are located at the both sides of the second display area.

9. The electronic device of claim 7, wherein:

the first emission controller is located at one side of the first display area; and the second emission controller is located at one side of the second display area.

10. The electronic device of claim 7, wherein the plurality of first and second scan drivers comprise a plurality of scan driving circuits configured to generate the scan signal provided to the pixels, and wherein the first and second emission controllers comprise a plurality of emission controlling circuits configured to generate the emission control signal provided to the pixels.

11. The electronic device of claim 7, wherein the first emission controller provides an emission control signal to the pixels in the first display area and the second emission controller provides an emission control signal to the pixels in the second display area.

12. The electronic device of claim 7, wherein the electronic device is implemented as a head mounted display (HMD) device that includes the display device.

13. The electronic device of claim 7, wherein the second emission controller comprises a first portion and a second portion, and the second display area comprises a second emission control line having a first end and a second end, the first end of the second emission control line being directly coupled to the first portion of the second emission controller, the second end of the second emission control line being directly coupled to the second portion of the second emission controller, the second emission controller being configured to apply the emission control signal to the second emission control line by applying the emission control signal to the first end of the second emission control line utilizing the first portion of the second emission controller and to the second end of the second emission control line utilizing the second portion of the second emission controller.

* * * * *